US010144058B2

(12) United States Patent
Miyamoto et al.

(10) Patent No.: US 10,144,058 B2
(45) Date of Patent: Dec. 4, 2018

(54) METHOD FOR MANUFACTURING ROUND BILLET OF NI-CONTAINING HIGH ALLOY HAVING IMPROVED INTERNAL QUALITY

(71) Applicant: NIPPON STEEL & SUMITOMO METAL CORPORATION, Tokyo (JP)

(72) Inventors: Seiji Miyamoto, Tokyo (JP); Takayoshi Kagari, Tokyo (JP)

(73) Assignee: NIPPON STEEL & SUMITOMO METAL CORPORATION, Tokyo (JP)

( * ) Notice: Subject to any disclaimer, the term of this patent is extended or adjusted under 35 U.S.C. 154(b) by 0 days.

(21) Appl. No.: 14/364,334

(22) PCT Filed: Aug. 8, 2013

(86) PCT No.: PCT/JP2013/071538
§ 371 (c)(1),
(2) Date: Jun. 11, 2014

(87) PCT Pub. No.: WO2014/024983
PCT Pub. Date: Feb. 13, 2014

(65) Prior Publication Data

US 2015/0144290 A1 May 28, 2015

(30) Foreign Application Priority Data

Aug. 9, 2012 (JP) ..... 2012-177406

(51) Int. Cl.
*B22D 11/00* (2006.01)
*B22D 11/12* (2006.01)
(Continued)

(52) U.S. Cl.
CPC ..... *B22D 11/001* (2013.01); *B22D 11/00* (2013.01); *B22D 11/002* (2013.01); *B22D 11/12* (2013.01);
(Continued)

(58) Field of Classification Search
CPC ..... B22D 11/002; B22D 11/00; B22D 11/001; B22D 11/12
See application file for complete search history.

(56) References Cited

U.S. PATENT DOCUMENTS

2008/0047635 A1* 2/2008 Kondo et al. ..... 148/541
2009/0056906 A1* 3/2009 Arvedi ..... B21B 1/463 164/471
2011/0308757 A1* 12/2011 Benedetti ..... B21B 1/463 164/460

FOREIGN PATENT DOCUMENTS

CN 101781743 7/2010
FR 2 667 524 4/1992
(Continued)

*Primary Examiner* — Kevin P Kerns
*Assistant Examiner* — Steven S Ha
(74) *Attorney, Agent, or Firm* — Clark & Brody

(57) ABSTRACT

Provided is a method for manufacturing a round billet of Ni-containing high alloy including steps of continuously casting a molten steel by using a casting mold, thereby obtaining a rectangular billet, and shaping the rectangular billet into round billet by forging/rolling, wherein the casting mold has a shape such that a w/h ratio between long side length (w) and short side length (h) of a cross section of the rectangular billet perpendicular to the casting direction of rectangular billet is 1.0 to 2.0, the chemical composition of molten steel is, by mass %: C: 0.005 to 0.250%, Si: 0.05 to 2.00%, Mn: 0.05 to 3.00%, P: 0.04% or less, S: 0.004% or less, Cu: 0.01 to 3.00%, Cr: 10 to 35%, Ni: 10 to 80%, Mo: 1.5 to 10.0%, Al: 0.001 to 0.300%, N: 0.001 to 0.300%, W: 0.00 to 6.00%, Ti: 0.00 to 2.00%, and the balance: Fe and impurities.

4 Claims, 8 Drawing Sheets

(51) Int. Cl.
*C22C 19/05* (2006.01)
*C22C 30/02* (2006.01)

(52) U.S. Cl.
CPC ..... *B22D 11/1206* (2013.01); *B22D 11/1213* (2013.01); *C22C 19/055* (2013.01); *C22C 19/056* (2013.01); *C22C 30/02* (2013.01)

(56) References Cited

FOREIGN PATENT DOCUMENTS

| | | | | |
|---|---|---|---|---|
| GB | 674723 | A | * | 7/1952 |
| JP | 61154703 | A | * | 7/1986 |
| JP | 01-228603 | | | 9/1989 |
| JP | 2004-360030 | | | 12/2004 |
| JP | 2008-214713 | | | 9/2008 |
| JP | 2009-120875 | | | 6/2009 |

* cited by examiner

METHOD FOR MANUFACTURING ROUND BILLET OF NI-CONTAINING HIGH ALLOY HAVING IMPROVED INTERNAL QUALITY

TECHNICAL FIELD

The present invention relates to a method for manufacturing a round billet of high alloy containing Ni.

BACKGROUND ART

Nowadays, in drilling of oil well and gas well, it has been required to drill until deeper stratum, and drill under more sever corrosive environment than before.

In such an environment, a seamless pipe made of high Cr-high Ni alloy having a good strength, corrosion resistance, and high-temperature resistance is used. Especially, a high Cr-high Ni—Mo steel is a material having a high strength showing high corrosion resistance even under hot sweet ($CO_2$) environment and hot sour ($H_2S$) environment.

One method that can be considered for productivity improvement and cost reduction in steel process is to change its casting method from an ingot casting method to a continuous casting method. In the ingot casting method, since a final solidification position of a steel ingot is a gate riser part, segregation portion and cavity portion are gathered to the gate riser part (upper portion of steel ingot). Therefore, in the ingot casting method, even though constant part of the steel ingot after the casting has a good quality, since the segregation portion and the cavity portion are required to be removed from the steel ingot after casting, the productivity improvement and cost reduction are restricted.

A process of manufacturing a seamless pipe from a rectangular billet made by continuous casting includes the steps of manufacturing a round billet from the rectangular billet by rolling or forging, and manufacturing a seamless pipe from the round billet. In the step of manufacturing the seamless pipe from the round billet, the internal quality (for example, intergranular cracking, cavity, segregation and the like) of the round billet to be used affects the quality of inner surface of the seamless pipe to be produced. Therefore, regarding the round billet used for manufacturing a seamless pipe, not only quality control of the outer surface but control of internal quality is also important.

In the continuous casting method, since cooling speed is faster comparing with the ingot casting method, cracking can occur in axial center. Also, in a case where a bending type continuous casting apparatus is used, there is a possibility that cracking occurs in accordance with deformation (unbending) of cast slab in moving from a bending part to a horizontal part of the apparatus.

If the continuous casting is tried to be applied to manufacture a high Cr-high Ni—Mo steel for manufacturing a seamless pipe, (1) segregation of Mo tends to be remained in the cast slab, (2) cavity tends to be remained in the cast slab, and (3) intergranular cracking tends to occur due to a high deformation resistance. Therefore, conventionally, it was difficult to employ the continuous casting method as a casting process of a high Cr-high Ni—Mo steel for manufacturing a seamless pipe.

Relating to manufacturing a seamless pipe of high Cr-high Ni based high alloy, Patent Document 1 discloses limiting contents of Zn and Pb contained in the alloy as impurity, and limiting total rolling ratio of billet (=(cross section before rolling)/(cross section after rolling)) in shaping a rectangular billet into a round billet. Patent Document 1 describes that according to this method, since cracking and flaw are difficult to occur on outer surface of the billet, a seamless pipe of high alloy having an improved outer surface quality can be manufactured.

However, regarding the internal quality of a round billet manufactured from a rectangular billet made by continuous casting of high Cr-high Ni—Mo steel and the inner surface quality of the seamless pipe manufactured from the round billet, any findings for quality improvement have not been obtained.

CITATION LIST

Patent Literature

Patent Document 1: Japanese Patent Application Laid-Open No. 2009-120875

SUMMARY OF THE INVENTION

Problems to be Solved by the Invention

An object of the present invention is to provide a method for manufacturing a round billet having a better internal quality, from a rectangular billet made by continuous casting of high Cr-high Ni—Mo steel.

Means for Solving the Problems

A method for manufacturing a round billet of Ni-containing high alloy according to the present invention comprises the steps of:

continuously casting a molten steel by means of a casting mold, thereby obtaining a rectangular billet; and shaping the rectangular billet into a round billet by forging or rolling, wherein the casting mold has a shape such that a w/h ratio between long side length (w) and short side length (h) of a cross section of the rectangular billet is 1.0 to 2.0, and the cross section is perpendicular to the casting direction of the rectangular billet;

the chemical composition of the molten steel is:

C: 0.005 to 0.250% by mass,
Si: 0.05 to 2.00% by mass,
Mn: 0.05 to 3.00% by mass,
P: no more than 0.04% by mass,
S: no more than 0.004% by mass,
Cu: 0.01 to 3.00% by mass,
Cr: 10 to 35% by mass,
Ni: 10 to 80% by mass,
Mo: 1.5 to 10.0% by mass,
Al: 0.001 to 0.300% by mass,
N: 0.001 to 0.300% by mass,
W: 0.00 to 6.00% by mass,
Ti: 0.00 to 2.00% by mass, and
the balance: Fe and impurities.

In the present invention, "casting direction of the rectangular billet" refers to a direction in which the rectangular billet is pulled out from the a continuous caster, and can be alternately referred to as "axis direction of the rectangular billet" or "extending direction of the rectangular billet". Normally, "long side length (w) of a cross section of the rectangular billet perpendicular to the casting direction of the rectangular billet" refers to a width of the rectangular billet, and "short side length (h) of a cross section of the rectangular billet perpendicular of the casting direction of the rectangular billet" refers to a thickness of the rectangular billet.

Preferably, a Mo segregation degree of the round billet is no more than 0.20. In the present invention, "No segregation degree of the round billet" refers to a ratio $((c_{Mo}'-c_{Mo})/c_{Mo})$ of a difference $(c_{Mo}'-c_{Mo})$ between Mo concentration at the axial center of the round billet ($c_{Mo}'$) and Mo concentration in the molten steel ($c_{Mo}$) to Mo concentration in the molten steel ($c_{Mo}$). In the present invention, "Mo concentration at the axial center of the round billet" is, defining a diameter of the round billet as D, determined by (1) at an end face of the round billet, collecting a sample by cutting a circular region of diameter D/20 of the round billet centering the axial center in an axis direction, (2) measuring the Mo concentration of the sample, by ICP atomic emission spectrometric method in accordance with JIS G1258-1 (Iron and steel—ICP atomic emission spectrometric method-Part 1: Determination of silicon, manganese, phosphorus, nickel, chromium, molybdenum, copper, vanadium, cobalt, titanium, and aluminium contents-Decomposition with acids and fusion with potassium disulfate). The Mo concentration of the molten steel is measured also by ICP atomic emission spectrometric method in accordance with JIS G1258-1, with regard to sample collected in accordance with JIS G0320 ("Standard test method for heat analysis of steel products").

Preferably, a ratio (A/B) between a cross section (A) of the rectangular billet before the shaping step and a cross section (B) of the round billet after the shaping step is 2.5 to 12.0. Hereinafter, the cross-sectional ratio A/B described above is sometimes referred to as "total forging ratio or total rolling ratio".

Preferably, soaking time of the rectangular billet before the shaping step is no less than 9 hours where the shaping is carried out by forging, and is no less than 24 hours where the shaping is carried out by rolling.

Effects of the Invention

According to the present invention, in manufacturing a round billet from a rectangular billet manufactured by a continuous casting of high Cr-high Ni—Mo steel, it is possible to increase internal quality of the round billet to be manufactured. According to the round billet manufactured by the method of the present invention, it is possible to increase quality of inner surface of a seamless pipe manufactured from the round billet.

MODES FOR CARRYING OUT THE INVENTION

Figure 1:
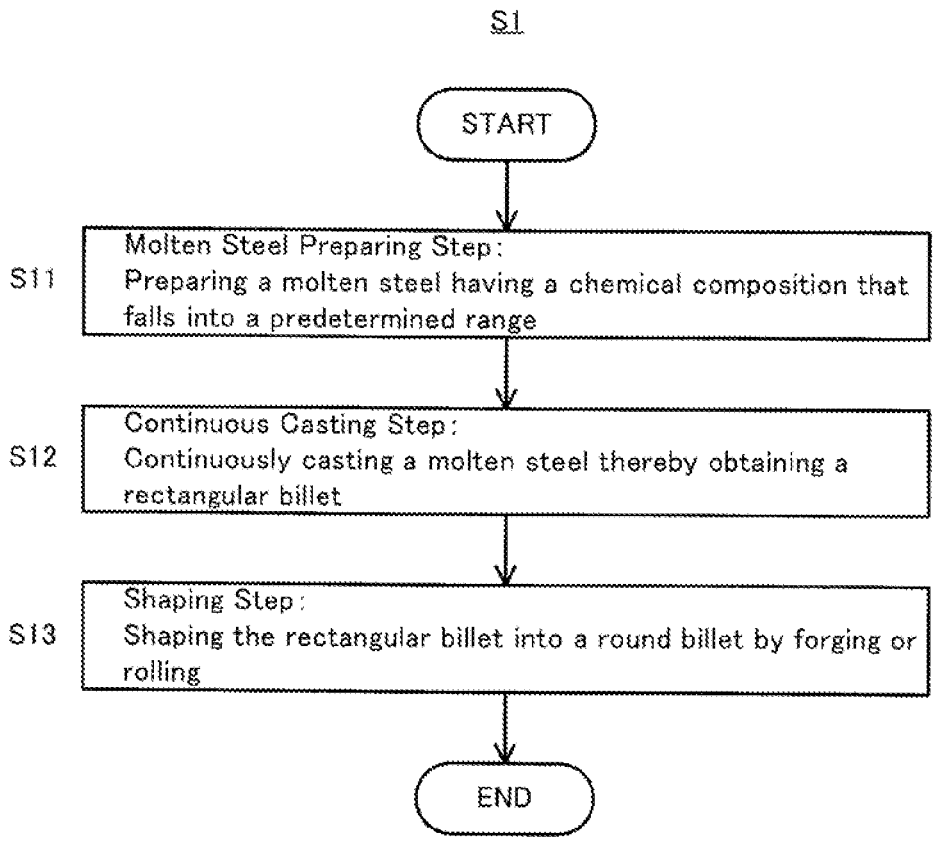
FIG. 1 is a flowchart illustrating a manufacturing method of a round billet of Ni-containing high alloy according to one embodiment.

Hereinafter, the present invention will be descried with reference to the drawings. It should be noted that embodiments shown below are examples of the present invention. Also, "A to B" regarding numerical values A and B means "A or more and B or less". In cases where the unit of the numerical value A is omitted, the unit given to the numerical value B is applied as the unit of the numerical value A. Moreover, in the following description, in cases where only "%" is given regarding content of elements, the notation means "mass %".

<(A) Chemical Composition of Molten Steel>

First of all, a chemical composition of high Ni-high Cr—Mo steel used in the present invention will be described.

C: 0.005 to 0.250%

C is a necessary element in order to obtain strength of steel material. Therefore, its content needs to be no less than 0.005%. Also, C inhibits generation of σ phase that is an embrittlement phase easy to segregate to Mo segregation part. However, if the content of C is more than 0. 250%, amount of $M_{23}C_6$ carbide is significantly increased, whereby ductility and toughness of the steel material are decreased. Therefore, the content of C in the molten steel of the present invent ion is 0.005 to 0.250%. If the content of C is 0.006 to 0.030%, the steel material has not only a better strength, ductility and toughness but also an improved corrosion resistance, therefore it is more preferable. M in above "$M_{23}C_6$ carbide" includes metal elements such as Cr, Fe and Mo in combination.

Si: 0.05 to 2.00%

Si is an element added as a deoxidizing agent in refining of steel. In order to onset this deoxidizing effect, content of Si needs to be no less than 0.05%. However, if the content of Si is more than 2.00%, ductility and toughness of the steel material is decreased. Therefore, the content of Si in the molten steel of the present invention is 0.05 to 2.00%. If the content of Si is 0.20 to 0.50%, the ductility and toughness of the molten steel is improved, therefore it is more preferable.

Mn: 0.05 to 3.00%

Mn is an element added as a deoxidizing agent in refining of steel. In order to onset this deoxidizing effect, content of Mn needs to be no less than 0.05%. However, if the content of Mn is more than 3.00%, ductility and toughness of the steel material are decreased, whereby cracking on an inner surface of pipe and blur crack of inner and outer surface of pipe of a seamless pipe manufactured from a round billet tend to occur. Therefore, the content of Mn in the molten steel of the present invention is 0.05 to 3.00%. It is more preferable that the content of Mn is 0.20 to 1.00%.

P: No More than 0.04%

P is an impurity element being mixed from raw materials and scrap. Generally, if a large amount of P exists in alloy, hot workability and corrosion resistance decrease. In particular, if content of P is more than 0.04%, hot workability and corrosion resistance of the steel material significantly decrease. Therefore, an acceptable content of P in the molten steel of the present invention is no more than 0.04%. It is more preferable that the content of P is no more than 0.03%.

S: No More than 0.004%

S is also an impurity element being mixed from raw materials and scrap. Generally, if a large amount of S exists in alloy, hot workability and corrosion resistance decrease. In particular, if content of S is more than 0.004%, hot workability and corrosion resistance significantly decrease. Therefore, an acceptable content of S in the molten steel of the present invention is no more than 0.004%. It is more preferable that the content of S is no more than 0.003%. If the content of S is no more than 0.0015%, the steel material shows outstanding hot workability, therefore it is further preferable.

Cu: 0.01 to 3.00%

Cu is an effective element for improving corrosion resistance of steel material, and the effect is obtained when content of Cu is no less than 0.01%. However, if the content of Cu is more than 3.00%, sometimes ductility and toughness of the steel material decrease. Therefore, the content of Cu in the molten steel of the present invention is 3.01 to 3.00%. It is more preferable that the content of Cu is 0.02 to 1.50%.

Cr: 10 to 35%

Cr, along with Mo and N, has a function to improve corrosion resistance of alloy. The effect is obtained when content of Cr is no less than 10%. However, if the content of Cr is more than 35%, hot workability of the alloy decreases. Therefore, the content of Cr in the molten steel of the present invention is 10 to 35%. It is more preferable that the content of Cr is 18 to 30%.

Ni: 10 to 80%

Ni, along with N, has a function to stabilize base material of austenite. Ni is an essential element in order to contain a large amount of elements having reinforcing property and corrosion-resistant property such as Cr and Mo in a high alloy. These effects are obtained when the content of Ni is no less than 10%. On the other hand, if a large amount of Ni is contained, cost of the alloy increases. In particular, if the content of Ni is more than 80%, the cost becomes significantly increased. Therefore, the content of Ni in the molten steel of the present invention is 10 to 80%. In view of inhibiting segregation of embrittlement phase caused by containing of Mo more effectively, the content of Ni is more preferably no less than 30%. On the other hand, in view of more inhibiting material cost of the alloy, the content of Ni is more preferably no more than 60%.

Mo: 1.5 to 10.0%

Mo has a function to increase strength and corrosion resistance of alloy under coexistence of Cr. The effect is obtained when content of Mo is no less than 1.5%. However, if the content of Mo is more than 10.0%, mechanical properties of the alloy such as ductility and toughness decrease. Therefore, the content of Mo in the molten steel of the present invention is 1.5 to 10.0%. It is more preferable that the content of Mo is 2.5 to 9.0%.

Al: 0.001 to 0.300%

Al is an element added as a deoxidizing agent in refining steel. The effect is obtained when content of Al is no less than 0.001%. On the other hand, if an excessive amount of Al is contained, cleanliness of alloy becomes deteriorated, and defect occurs originated from inclusion. Therefore, the content of Al in the molten steel of the present invention is 0.001 to 0.300%. It is more preferable that the content of Al is 0.001 to 0.200%.

N: 0.001 to 0.300%

N, along with Ni, has a function to stabilize base material of austenite. In order to obtain the function, content of N needs to be no less than 0.001%. On the other hand, if an excessive amount of N is contained, toughness of the steel material possibly decreases significantly. Therefore, the content of N in the molten steel of the present invention is 0.001 to 0.300%. It is more preferable that the content of N is 0.004 to 0.270%.

W: 0.00 to 6.00%

In the present invention, the molten steel can contain W, but does not have to contain W. If an excessive amount of W is contained, cost of alloy increases excessively. In specific, if the content of W is more than 6.00%, increase of the cost of alloy is extremely large. Therefore, the content of W in the molten steel of the present invention is 0.00 to 6.00%. W, an optional element to contain, has a function to increase strength and corrosion resistance of alloy under coexistence of Cr. The effect can be obtained when the content of W is no less than 0.01%. Therefore, the content of W is more preferably 0.01 to 6.00%.

Ti: 0.00 to 2.00%

In the present invention, the molten steel can contain Ti, but does not have to contain Ti. If an excessive amount of Ti is contained, hot workability of alloy decreases, therefore content of Ti in the molten steel of the present invention is 0.00 to 2.00%. Ti, an optional element to contain, has function of deacidification and stabilizing C. Especially, in a stainless steel, by fixating C with Ti to prevent generation of $Cr_3C_2$, whereby it is possible to inhibit Cr-depleted layer from being produced. In order to obtain this effect, content of Ti needs to be no less than 0.05%. Therefore, the content of Ti is preferably 0.05 to 2.00% and more preferably, 0.05 to 1.50%.

<(B) Shape of Casting Mold>

The casting mold used for continuous casting of a high Ni-high Cr Mo steel in the present invention has a shape such that a w/h ratio between long side length (w) and short side length (h) of a cross section of the rectangular billet is to 1.0 to 2.0, and the cross section is perpendicular to the casting direction (direction in which the continuously-casted rectangular billet continues) of the rectangular billet. Normally, "long side length (w) of a cross section of the rectangular billet perpendicular to the casting direction" refers to a width of the rectangular billet, and "short side direction (h) of a cross section of the rectangular billet perpendicular to the casting direction" refers to a thickness of the rectangular billet. In the middle of solidifying of steel, if a process of correct a curved cast slab to be flat is applied (that is, the continuous casting is carried out by a continuous casting apparatus other than a vertical type continuous casting apparatus, such as a bending type continuous casting apparatus and a vertical bending type continuous casting apparatus), regarding the above "cross section of the rectangular billet perpendicular to the casting direction", (1) the "long side length (w)" is to be taken in a direction that does not change in the above process of correcting the curved cast slab to be flat (that is, the horizontal direction when the rectangular billet is pulled out from the continuous casting apparatus), and (2) the "short side length (h)" is to be taken in a direction that changes in the process of correcting the curved cast slab to be flat (that is, the vertical direction when the rectangular billet is pulled out from the continuous casting apparatus). Hereinafter, the ratio w/h is sometimes referred to as "aspect ratio" for descriptive purpose.

If the aspect ratio w/h of the casting mold used for the continuous casting is more than 2.0, the internal quality of the round billet decreases. It is considered that this comes from a remaining portion of segregation that becomes wider because the width of final solidification portion becomes long. On the other hand, if the aspect ratio w/h of the casting mold is less than 1.0, in a case where a continuous casting apparatus that corrects the cast slab curved in the middle of solidifying of the steel to flat (bending type continuous casting apparatus or vertical bending type continuous casting apparatus) is used, a great deal of power is required to correct the rectangular billet. Therefore, the aspect ratio w/h of the continuous casting mold in the present invention needs to be 1.0 or more and 2.0 or less. In view of further improving the internal quality of the round billet, the ratio w/h of the casting mold is more preferably 1.0 or more and 1.7 or less.

<(C) Manufacturing Method of Round Billet>

FIG. 1 is a flowchart illustrating a manufacturing method S1 of a round billet of Ni-containing high alloy (hereinafter, sometimes referred to as "manufacturing method S1" or simply "S1") according to one embodiment of the present invention. As shown in FIG. 1, the manufacturing method S1 includes a molten steel preparation step S11 (hereinafter sometimes referred to as "S1" in short), a continuous casting step S12 (hereinafter sometimes referred to as "S12" in short) and a shaping step S13 (hereinafter sometimes referred to as "S13" in short) in the order mentioned. The molten steel preparation step S11 is a step to make a molten metal of high alloy having chemical composition described above (nigh Ni-high Cr—Mo steel). The continuous casting step S12 is a step to continuously cast the molten metal prepared in S11, by means of the casting mold having the shape described above, thereby obtaining a rectangular billet. The shaping method S13 is a step to shape the rectangular billet obtained in S12 into a round billet by forging or rolling.

Figure 2:
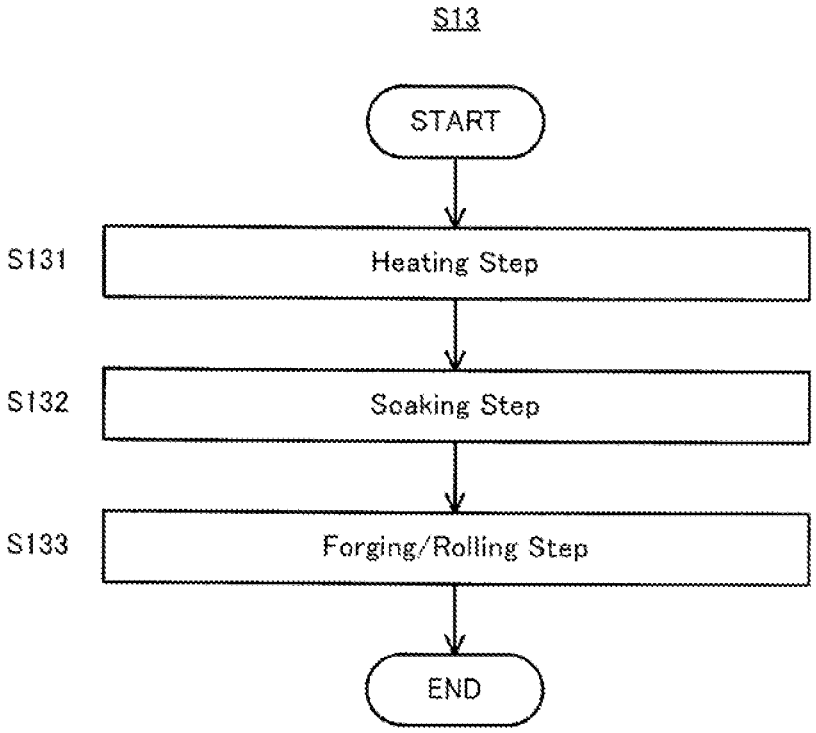
FIG. 2 is a flowchart illustrating a detail of a step to shape a rectangular billet into a round billet in the manufacturing method of a round billet of Ni-containing high alloy according to one embodiment of the present invention.

FIG. 2 is a flowchart illustrating the shaping step S13 further in detail. As shown in FIG. 2, the shaping step S13 includes a heating step S131 (hereinafter sometimes referred to as "S131" in short), a soaking step S132 (hereinafter sometimes referred to as "S132" in short), and a forging/rolling step S133 (hereinafter sometimes referred to as "S133" in short) in the order mentioned. The heating step S131 is a step to heat the rectangular billet obtained by the continuous casting step S12 to a temperature of no more than 1300° C. S131 has a meaning of preventing cracking and flaw on the surface of the round billet to be manufactured, by preventing generation of cracking caused by melting of grain boundary in forging or rolling. The soaking step S132 is a step to soak the rectangular billet that went through S131. The forging/rolling step S133 is a step to apply forging or rolling to the rectangular billet that went through S132 while the temperature of the rectangular billet is no less than 800° C., thereby shaping the rectangular billet into a round billet. While the temperature of the rectangular billet is no less than 800° C., deformation resistance of the material is not too large, therefore load to be applied to the forging apparatus or rolling apparatus is not to be excessive.

The soaking time in the soaking step S132 is preferably no less than 9 hours where shaping by forging is employed in S133, and is preferably no less than 24 hours where shaping by rolling is employed in S133. By securing the soaking time no less than the lower value described above before shaping the rectangular billet into the round billet, it is possible to effectively improve the internal quality of the round billet to be manufactured. The reason can be presumed as below. That is, the reason is considered that by soaking the rectangular billet for a sufficiently long period of time, (1) diffusing of the component elements inside the rectangular billet is sufficiently progressed, (2) by diffusing of the component elements inside the rectangular billet, segregation that had occurred inside the rectangular billet is eased, and (3) as a result of easing of segregation inside the rectangular billet, generation of a fragile σ phase can be inhibited. In the soaking step S132, it is preferable to carry out the soaking under a temperature condition of 1200 to 1300° C., and it is more preferable to carry out the soaking under a temperature condition of 1240 to 1300° C.

In the forging/rolling step S133, it is preferable that the total forging ratio or the total rolling ratio is 2.5 to 12.0. Here, "the total forging ratio or the total rolling ratio" refers to the ratio A/B of the cross section (A) in the axis direction of the rectangular billet before the shaping step S13 to the cross section (B) in the axis direction of the round billet after the shaping step S13. In shaping the rectangular billet of high Ni-high Cr—Mo steel into a round billet by forging or rolling, if the total forging ratio or the total rolling ratio is too large, cracking and flaw tend to occur on the surface of the round billet after shaping. On the other hand, if the total forging ratio or the total rolling ratio is too small, intergranular cracking and cavity tend to be remained to the round billet after shaping.

A Mo segregation degree of the round billet after the shaping step S13 is preferably no more than 0.20. The term "Mo segregation degree of the round billet" refers to a ratio $((c_{Mo}'-c_{Mo})/c_{Mo})$ of a difference $(c_{Mo}'-c_{Mo})$ between Mo concentration at the axis center of the round billet $(c_{Mo}')$ and Mo concentration in the molten steel $(c_{Mo})$ to Mo concentration in the molten steel $(c_{Mo})$. In the present invention, the Mo segregation degree of the round billet certainly has a value of no less than 0.00. The Mo segregation degree of the round billet being no more than 0.20 makes it possible to inhibit generation of cracking and flaw on inner surface of the pipe in manufacturing a seamless pipe from the round billet.

EXAMPLES

Alloys each having a chemical composition shown in Table 1 below was melted by EF (electric furnace)-AOD (Argon Oxygen Decarburization)-VOD (Vacuum Oxygen Decarburization) process, thereafter, rectangular billets were obtained by a continuous casting method or an ingot casting method. Next, each of the rectangular billets was soaked with a soaking condition (soaking temperature and soaking time) shown in Table 2, thereafter, forging or rolling was carried out to the rectangular billet to obtain a round billet. Regarding each cast slab, the soaking temperature was within the range in which the forging or rolling was able to be carried out. Regarding each cast slab, finishing temperature in the forging or the rolling was no less than 800° C.

The Mo segregation degree of the round billet was used as an index of the evaluation of segregation degree of the round billet. Among the compositions of the molten steel described above, Si, Mn, Cr, Mo, Ti and W are elements to promote generation of σ phase being an embrittlement phase. Among those, Mo has a slow diffusion speed, and is large in content in the molten steel. Therefore, a segregation degree of a whole round billet was evaluated by its Mo segregation degree. For each obtained round billet, the Mo segregation degree was determined as follows.

(1) Measurement of Mo Concentration at the Center Portion of Billet (1-a) Defining the diameter of the round billet as D, at the end face of the round billet, a sample was collected by cutting a circle area of diameter D/20 centering the axial center of the round billet in an axis direction of the round billet;

(1-b) The Mo concentration in the sample was measured by ICP atomic emission spectrometric method in accordance with JIS G1258-1 (Iron and steel—ICP atomic emission spectrometric method—Part 1: Determination of silicon, manganese, phosphorus, nickel, chromium, molybdenum, copper, vanadium, cobalt, titanium and aluminium contents—Dissolution in acids and fusion with potassium disulfate). The number of the times was set to be no less than three, and an average value when measurement was carried out more than once until the allowable tolerance (error) defined in JIS G1258-1 became no more than 0.5% of the average was set to be the Mo concentration ($c_{Mo}'$) of the center portion of the billet.

(2) Measurement of Mo Concentration in Molten Steel

The Mo concentration of the Molten Steel was measured by ICP atomic emission spectrometric method in accordance with JIS G1258-1, regarding sample collected in accordance with JIS G0320 ("Standard test method for heat analysis of steel products"). Number of the measurement was set to be no less than three, and an average value when measurement was carried out more than once until the allowable tolerance (error) defined in JIS G1258-1 became no more than 0.5% of the average was set to be the Mo concentration (co) of the molten steel.

(3) Determination of Mo Segregation Degree

Based on $c_{Mo}'$ and $c_{Mo}$ determined by above (1) and (2), the Mo segregation degree ($r_{Mo}$) of the round billet was calculated from formula (1) below.

$$r_{Mo}=(c_{Mo}'-c_{Mo})/c_{Mo} \quad (1)$$

According to the above formula (1), it is possible to evaluate degree of Mo segregation even between billets having different contents of Mo in molten steel.

In Table 2, the aspect ratio w/h of the casting mold, the Mo segregation degree of the round billet, the shaping method of the rectangular billet (forging/rolling) and the total forging ratio or the total rolling ratio in shaping the rectangular billet into the round billet were described altogether.

In Tables 1 and 2, chemical composition of the molten steel, aspect ratio w/h of the casting mold and Mo segregation degree of the round billet of each of Items 1 to 3 are in the scope of the present invention. Also, among chemical composition of the molten steel, aspect ratio w/h of the casting mold, and Mo segregation degree of the round billet of each of Items 32 to 37, units each given a symbol "*" is outside of the scope of the present invention. Each of Items 38 and 39 is an example in which the rectangular billet was casted not by continuous casting but by ingot.

Regarding each of Items 1 to 39, no less than 20 of round billets were manufactured, and from each of the round billets, a seamless pipe was manufactured by Ugine process or Mannesmann process. In each of the items, the number of the seamless pipes manufactured by Ugine process, and the number of the seamless pipe manufactured by Mannesmann process were no less than five, respectively. Regarding each manufactured seamless pipe, presence or absence of σ phase being an embrittlement phase that tends to be generated at Mo segregation portion was checked to judge each seamless pipe if it is accepted as a product or not. The seamless pipe in which σ phase was detected was defined as not acceptable, and the seamless pipe in which σ phase was not detected was defined as acceptable. The checking method of presence or absence of σ phase is as follows. That is, a sample was collected from each seamless pipe in a direction (diameter direction) vertical to the axis direction, then etching was applied to the surface of the sample, after that, the sample was observed by an optical microscope. If the reject ratio of the manufactured seamless pipes is less than 10%, it can be judged that the inner surface of the pipe has a good quality.

TABLE 1

| | Chemical Composition (Mass %) | | | | | | | | | | | | | |
|---|---|---|---|---|---|---|---|---|---|---|---|---|---|---|
| Item No. | C | Si | Mn | P | S | Cu | Cr | Ni | Mo | Al | N | Ti | W | Remaining Part |
| 1 | 0.110 | 1.60 | 0.24 | 0.016 | 0.0005 | 0.10 | 25.20 | 37.92 | 2.17 | 0.130 | 0.060 | — | — | Fe and impurities |
| 2 | 0.098 | 1.51 | 0.27 | 0.028 | 0.0037 | 0.71 | 25.11 | 37.09 | 1.52 | 0.221 | 0.119 | — | — | Fe and impurities |
| 3 | 0.009 | 1.11 | 0.29 | 0.037 | 0.0008 | 0.42 | 25.45 | 37.12 | 2.25 | 0.064 | 0.083 | — | — | Fe and impurities |
| 4 | 0.220 | 1.56 | 0.34 | 0.021 | 0.0023 | 0.10 | 32.60 | 37.24 | 4.25 | 0.013 | 0.107 | — | — | Fe and impurities |
| 5 | 0.008 | 0.34 | 0.59 | 0.014 | 0.0021 | 0.80 | 24.06 | 50.04 | 6.37 | 0.067 | 0.016 | 0.069 | — | Fe and impurities |
| 6 | 0.110 | 1.60 | 2.70 | 0.019 | 0.0017 | 0.10 | 25.20 | 37.89 | 9.10 | 0.013 | 0.095 | — | — | Fe and impurities |
| 7 | 0.011 | 1.98 | 0.24 | 0.016 | 0.0008 | 2.11 | 34.60 | 36.11 | 8.23 | 0.114 | 0.143 | — | — | Fe and impurities |
| 8 | 0.210 | 0.55 | 0.59 | 0.014 | 0.0010 | 1.90 | 18.20 | 37.54 | 7.02 | 0.130 | 0.179 | — | — | Fe and impurities |
| 9 | 0.110 | 0.78 | 0.24 | 0.019 | 0.0003 | 0.10 | 24.97 | 37.81 | 3.31 | 0.167 | 0.060 | — | — | Fe and impurities |
| 10 | 0.018 | 1.60 | 1.60 | 0.029 | 0.0012 | 1.87 | 31.20 | 10.35 | 8.51 | 0.004 | 0.083 | — | — | Fe and impurities |
| 11 | 0.021 | 0.91 | 0.24 | 0.016 | 0.0020 | 0.10 | 25.13 | 37.61 | 2.19 | 0.240 | 0.107 | — | — | Fe and impurities |
| 12 | 0.019 | 0.84 | 0.59 | 0.012 | 0.0011 | 0.91 | 32.40 | 35.11 | 3.33 | 0.013 | 0.024 | — | — | Fe and impurities |
| 13 | 0.071 | 0.87 | 0.24 | 0.014 | 0.0009 | 1.71 | 25.12 | 36.12 | 1.92 | 0.012 | 0.095 | — | — | Fe and impurities |
| 14 | 0.008 | 0.34 | 0.53 | 0.014 | 0.0007 | 0.80 | 24.08 | 50.04 | 6.37 | 0.067 | 0.096 | 0.069 | — | Fe and impurities |
| 15 | 0.024 | 0.80 | 1.71 | 0.021 | 0.0012 | 1.58 | 20.20 | 22.35 | 2.83 | 0.075 | 0.075 | 0.678 | 0.050 | Fe and impurities |
| 16 | 0.150 | 0.34 | 0.24 | 0.022 | 0.0006 | 2.70 | 12.50 | 76.40 | 6.37 | 0.067 | 0.040 | 0.069 | — | Fe and impurities |
| 17 | 0.008 | 0.99 | 1.59 | 0.027 | 0.0017 | 0.80 | 24.08 | 50.04 | 4.41 | 0.089 | 0.080 | 0.071 | — | Fe and impurities |
| 18 | 0.012 | 1.12 | 1.91 | 0.028 | 0.0021 | 1.98 | 23.98 | 51.45 | 4.04 | 0.214 | 0.056 | 0.812 | — | Fe and impurities |
| 19 | 0.110 | 1.59 | 0.53 | 0.016 | 0.0009 | 0.10 | 17.20 | 70.20 | 7.01 | 0.013 | 0.107 | — | — | Fe and impurities |
| 20 | 0.008 | 0.34 | 0.27 | 0.016 | 0.0006 | 0.80 | 24.08 | 50.04 | 6.37 | 0.067 | 0.016 | 0.069 | — | Fe and impurities |
| 21 | 0.024 | 0.24 | 0.24 | 0.021 | 0.0009 | 1.58 | 22.60 | 39.58 | 9.20 | 0.075 | 0.040 | 0.676 | 0.050 | Fe and impurities |
| 22 | 0.011 | 0.23 | 1.21 | 0.023 | 0.0008 | 2.65 | 20.20 | 40.01 | 2.83 | 0.098 | 0.060 | 0.712 | 0.400 | Fe and impurities |
| 23 | 0.190 | 0.29 | 1.85 | 0.006 | 0.0012 | 2.20 | 15.59 | 75.73 | 5.21 | 0.115 | 0.066 | — | — | Fe and impurities |
| 24 | 0.008 | 0.34 | 2.72 | 0.016 | 0.0016 | 0.80 | 24.08 | 50.04 | 6.37 | 0.067 | 0.040 | 0.069 | — | Fe and impurities |
| 25 | 0.024 | 0.24 | 1.61 | 0.021 | 0.0018 | 1.58 | 33.20 | 39.58 | 2.83 | 0.075 | 0.050 | 0.678 | 0.050 | Fe and impurities |

TABLE 1-continued

| Item No. | Chemical Composition (Mass %) | | | | | | | | | | | | | |
|---|---|---|---|---|---|---|---|---|---|---|---|---|---|---|
| | C | Si | Mn | P | S | Cu | Cr | Ni | Mo | Al | N | Ti | W | Remaining Part |
| 26 | 0.087 | 1.11 | 0.24 | 0.031 | 0.0015 | 0.64 | 20.20 | 55.78 | 4.32 | 0.054 | 0.035 | 0.678 | 0.050 | Fe and impurities |
| 27 | 0.110 | 1.60 | 2.01 | 0.032 | 0.0022 | 0.69 | 25.19 | 37.88 | 2.14 | 0.013 | 0.107 | — | — | Fe and impurities |
| 28 | 0.008 | 0.34 | 0.59 | 0.016 | 0.0027 | 0.80 | 24.08 | 50.04 | 6.37 | 0.067 | 0.016 | 0.069 | — | Fe and impurities |
| 29 | 0.024 | 0.24 | 0.53 | 0.021 | 0.0017 | 1.58 | 15.40 | 62.79 | 2.83 | 0.074 | 0.040 | 0.678 | 0.050 | Fe and impurities |
| 30 | 0.110 | 1.60 | 0.24 | 0.016 | 0.0023 | 0.10 | 25.20 | 37.77 | 2.21 | 0.016 | 0.143 | — | — | Fe and impurities |
| 31 | 0.101 | 1.47 | 0.75 | 0.014 | 0.0013 | 0.83 | 25.11 | 24.52 | 2.46 | 0.112 | 0.179 | — | — | Fe and impurities |
| 32 | 0.019 | 0.31 | 0.24 | 0.022 | 0.0011 | 1.60 | 25.88 | 37.08 | 2.10 | 0.215 | 0.060 | — | — | Fe and impurities |
| 33 | 0.021 | 1.20 | 0.88 | 0.029 | 0.0023 | 1.11 | 32.40 | 37.54 | 4.45 | 0.021 | 0.119 | — | — | Fe and impurities |
| 34 | 0.034 | 1.47 | 0.24 | 0.016 | 0.0031 | 2.23 | 25.26 | 37.22 | 3.14 | 0.045 | 0.083 | — | — | Fe and impurities |
| 35 | 0.210 | 0.24 | 1.71 | 0.021 | 0.0012 | 1.58 | 20.20 | 39.58 | 2.83 | 0.072 | 0.045 | 0.678 | 0.050 | Fe and impurities |
| 36 | 0.110 | 1.51 | 0.24 | 0.016 | 0.0045* | 0.10 | 31.49 | 37.07 | 1.98 | 0.018 | 0.024 | — | — | Fe and impurities |
| 37 | 0.008 | 0.34 | 2.50 | 0.014 | 0.0012 | 0.80 | 24.08 | 50.04 | 6.37 | 0.067 | 0.064 | 0.069 | — | Fe and impurities |
| 38 | 0.009 | 0.32 | 1.60 | 0.025 | 0.0009 | 0.79 | 24.00 | 50.13 | 6.39 | 0.109 | 0.108 | 0.083 | 0.040 | Fe and impurities |
| 39 | 0.022 | 0.26 | 1.80 | 0.019 | 0.0012 | 1.75 | 20.98 | 39.70 | 2.89 | 0.064 | 0.667 | 0.667 | 0.050 | Fe and impurities |

TABLE 2

| Item No. | Casting Method | Ratio w/h of Casting Mold | Shaping Method | Soaking Temperature (° C.) | Soaking Time (h) | Total Forging Ratio Total Rolling Ratio | Cracking Remainig of Center of Billet | Mo Segregation Degree of Bilet | Reject Ratio of Seamless Pipe (%) |
|---|---|---|---|---|---|---|---|---|---|
| 1 | Continuous Casting | 1.1 | Forging | 1250 | 9 | 3.4 | None | 0.16 | 5.0 |
| 2 | Continuous Casting | 1.1 | Forging | 1250 | 12 | 4.1 | None | 0.14 | 4.6 |
| 3 | Continuous Casting | 1.1 | Forging | 1270 | 12 | 4.1 | None | 0.13 | 4.0 |
| 4 | Continuous Casting | 1.3 | Forging | 1270 | 9 | 7.8 | None | 0.15 | 4.5 |
| 5 | Continuous Casting | 1.3 | Forging | 1290 | 15 | 4.8 | None | 0.07 | 1.0 |
| 6 | Continuous Casting | 1.3 | Forging | 1250 | 12 | 7.8 | None | 0.16 | 5.0 |
| 7 | Continuous Casting | 1.5 | Forging | 1270 | 9 | 5.5 | None | 0.12 | 4.0 |
| 8 | Continuous Casting | 1.5 | Forging | 1290 | 9 | 9.0 | None | 0.11 | 2.0 |
| 9 | Continuous Casting | 1.5 | Forging | 1250 | 12 | 5.5 | None | 0.15 | 4.5 |
| 10 | Continuous Casting | 1.7 | Forging | 1250 | 9 | 6.2 | None | 0.16 | 1.5 |
| 11 | Continuous Casting | 1.7 | Forging | 1290 | 9 | 10.1 | None | 0.11 | 2.0 |
| 12 | Continuous Casting | 1.6 | Forging | 1250 | 24 | 5.5 | None | 0.12 | 3.0 |
| 13 | Continuous Casting | 1.9 | Forging | 1250 | 9 | 6.3 | None | 0.17 | 10.0 |
| 14 | Continuous Casting | 1.9 | Forging | 1290 | 12 | 6.3 | None | 0.14 | 9.0 |
| 15 | Continuous Casting | 1.9 | Forging | 1250 | 16 | 6.4 | None | 0.18 | 9.5 |
| 16 | Continuous Casting | 1.1 | Rolling | 1270 | 30 | 3.4 | None | 0.14 | 4.5 |
| 17 | Continuous Casting | 1.1 | Rolling | 1250 | 30 | 4.1 | None | 0.12 | 2.5 |
| 18 | Continuous Casting | 1.3 | Rolling | 1290 | 30 | 4.8 | None | 0.08 | 0.5 |
| 19 | Continuous Casting | 1.3 | Rolling | 1250 | 24 | 4.8 | None | 0.14 | 5.5 |
| 20 | Continuous Casting | 1.3 | Rolling | 1270 | 24 | 7.8 | None | 0.12 | 4.5 |
| 21 | Continuous Casting | 1.3 | Rolling | 1290 | 30 | 7.4 | None | 0.09 | 1.5 |
| 22 | Continuous Casting | 1.5 | Rolling | 1290 | 30 | 5.5 | None | 0.08 | 3.0 |
| 23 | Continuous Casting | 1.5 | Rolling | 1290 | 36 | 5.5 | None | 0.04 | 0.5 |
| 24 | Continuous Casting | 1.5 | Rolling | 1250 | 16 | 9.0 | None | 0.20 | 9.5 |
| 25 | Continuous Casting | 1.5 | Rolling | 1270 | 36 | 9.0 | None | 0.07 | 3.0 |
| 26 | Continuous Casting | 1.7 | Rolling | 1270 | 36 | 6.2 | None | 0.09 | 2.0 |
| 27 | Continuous Casting | 1.7 | Rolling | 1250 | 36 | 10.1 | None | 0.18 | 4.5 |
| 28 | Continuous Casting | 1.7 | Rolling | 1270 | 30 | 10.1 | None | 0.09 | 1.5 |
| 29 | Continuous Casting | 1.9 | Rolling | 1290 | 36 | 6.2 | None | 0.18 | 9.5 |
| 30 | Continuous Casting | 1.9 | Rolling | 1270 | 24 | 6.3 | None | 0.16 | 8.0 |
| 31 | Continuous Casting | 1.9 | Rolling | 1290 | 24 | 11.4 | None | 0.19 | 8.8 |
| 32 | Continuous Casting | 2.1* | Forging | 1270 | 12 | 7.4 | None | 0.26* | 34.2 |
| 33 | Continuous Casting | 2.3* | Forging | 1250 | 9 | 2.4 | Remained | 0.29* | 81.1 |
| 34 | Continuous Casting | 2.3* | Forging | 1270 | 16 | 8.2 | None | 0.24* | 21.5 |
| 35 | Continuous Casting | 2.1* | Rolling | 1250 | 36 | 4.8 | None | 0.22* | 17.5 |
| 36 | Continuous Casting | 2.3* | Rolling | 1270 | 24 | 4.0 | None | 0.26* | 37.6 |
| 37 | Continuous Casting | 2.3* | Rolling | 1250 | 30 | 2.9 | Remained | 0.25* | 49.2 |
| 38 | Ingot* | 1.0 | Forging | 1290 | 24 | 8.0 | None | 0.09 | 0.5 |
| 39 | Ingot* | 1.0 | Rolling | 1250 | 24 | 8.0 | None | 0.07 | 1.6 |

Figure 3:
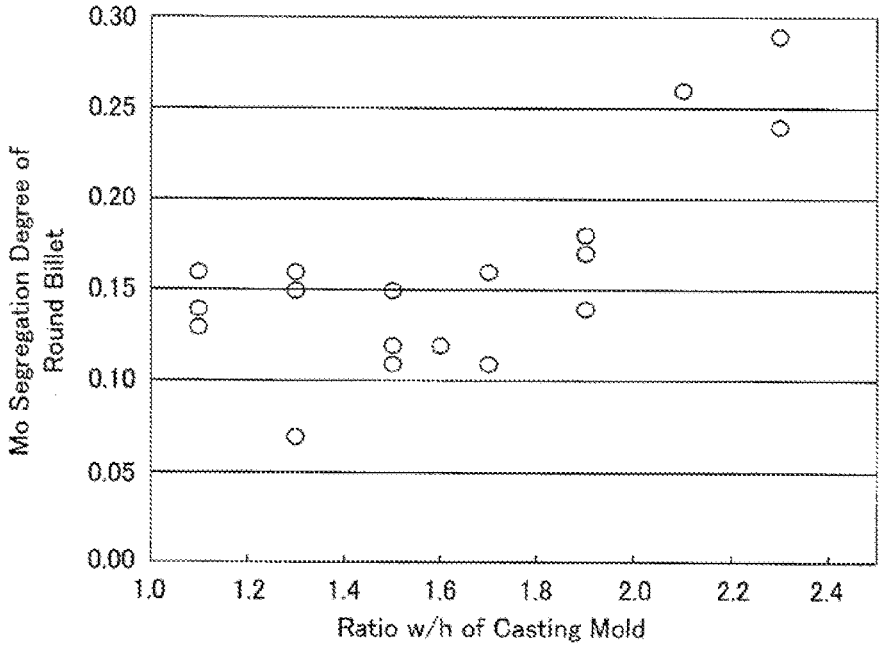
FIG. 3 is a scatter chart showing relationship between a ratio w/h of a casting mold and Mo segregation degree of the round billet in a case where forging is employed as a shaping method.

FIG. 3 is a scatter chart showing relationship between the aspect ratio w/h of the casting old and the Mo segregation degree of the round billet in a case where forging is employed as the shaping method. It can be seen from FIG. 3 that when the aspect ratio w/h of the casting mold was no more than 2.0, the Mo segregation degree of the round billet was eased to be no more than 0.20.

Figure 4:
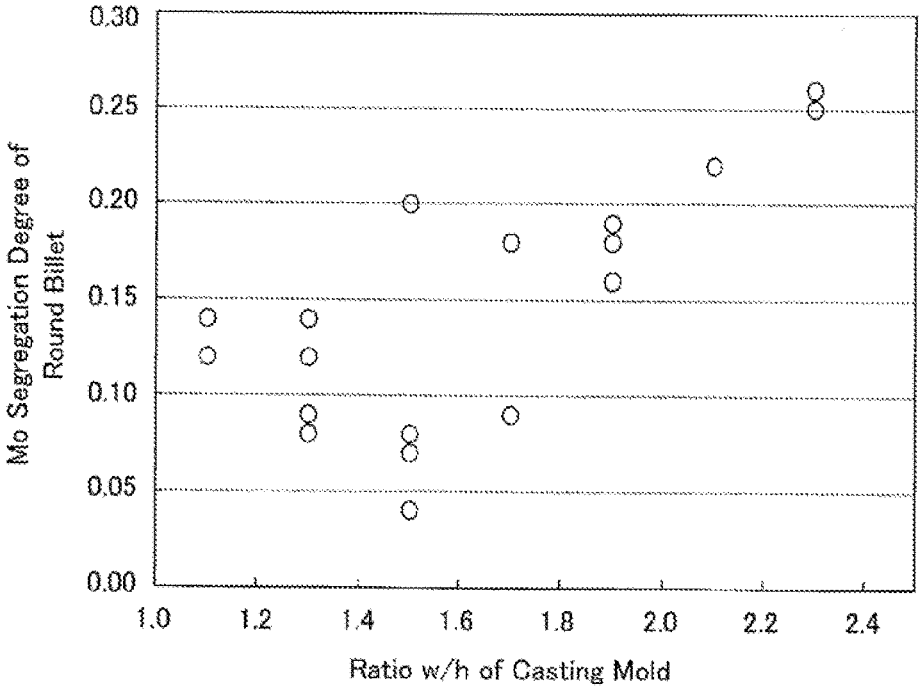
FIG. 4 is a scatter chart showing relationship between the ratio w/h of a casting mold and the Mo segregation degree of the round billet in a case where rolling is employed as the shaping method.

FIG. 4 is a scatter chart showing relationship between the aspect ratio w/h of the casting mold and the Mo segregation degree of the round billet in a case where rolling is employed as the shaping method. In the same manner, it can be seen from FIG. 4 that when the aspect ratio w/h of the casting mold was no more than 2.0, the Mo segregation degree of the round billet was eased to be no more than 0.20.

Figure 5:
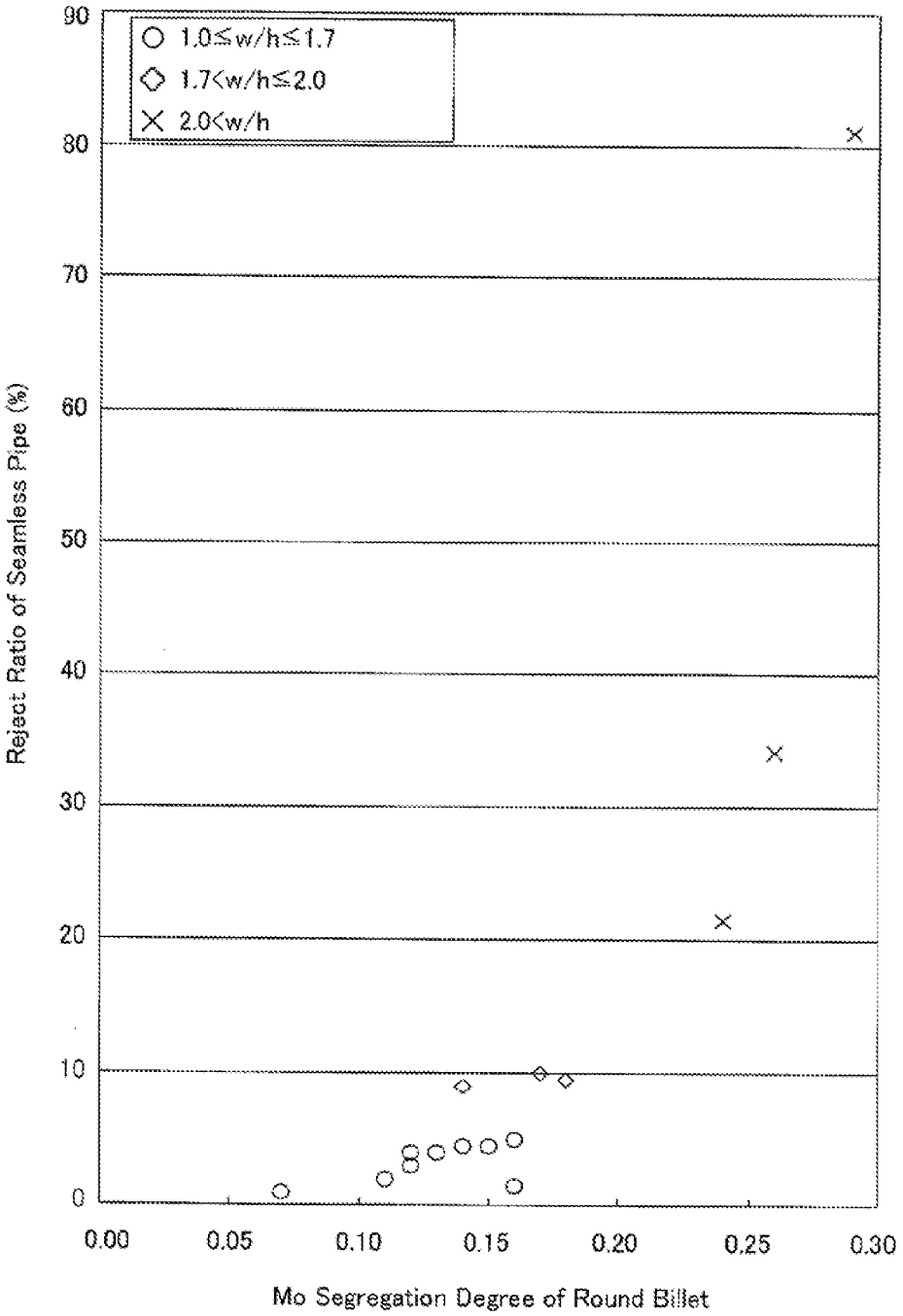
FIG. 5 is a scatter chart showing relationship between the Mo segregation degree of the round billet formed by forging and reject ratio of seamless pipe.

FIG. 5 is a scatter chart showing relationship between the Mo segregation degree of the round billet shaped by forging and the reject ratio of the seamless pipes. It can be seen from FIG. 5 that when the Mo segregation degree of the round billet was no more than 0.20, the reject ratio of the seamless pipes was reduced to no more than 10%. In addition, according to FIG. 5, in examples in which the Mo segregation degree was no more than 0.20, the aspect ratio w/h of the casting mold was 1.0 or more and 2.0 or less.

Figure 6:
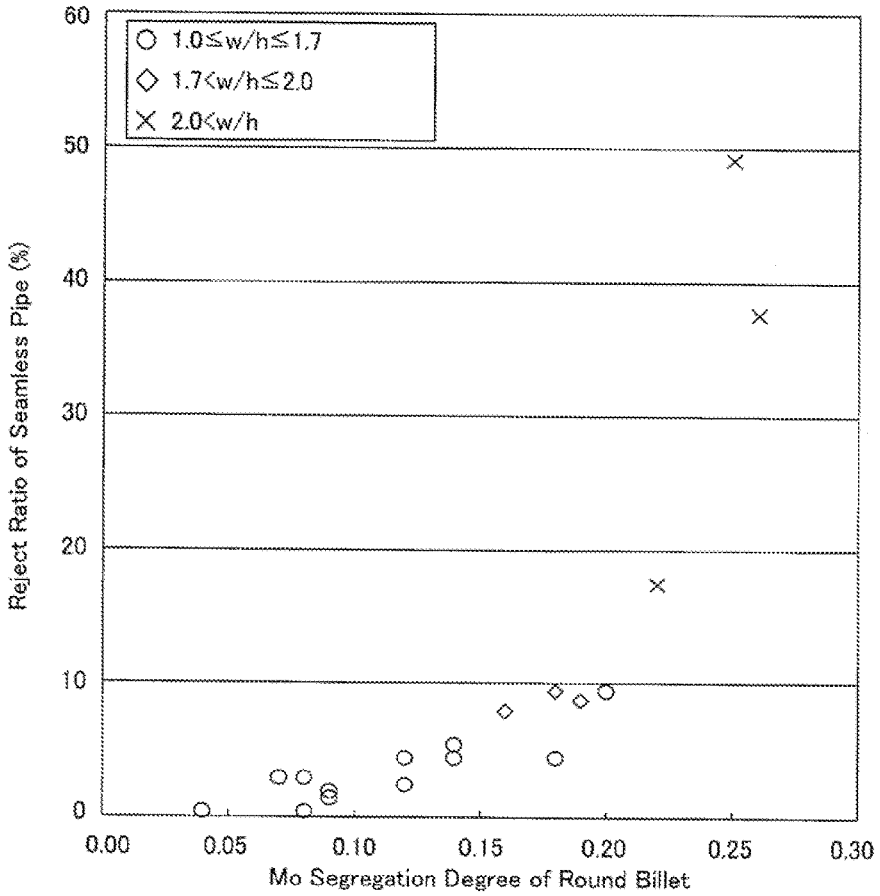
FIG. 6 is a scatter chart showing relationship between the Mo segregation degree of the round billet formed by rolling and reject ratio of seamless pipe.

FIG. 6 is a scatter chart showing relationship between the Mo segregation degree of the round billet shaped by rolling and the reject ratio of the seamless pipes. It can be seen from FIG. 6 that, when the Mo segregation degree of the round billet was no more than 0.20, the reject ratio of the seamless pipes was reduced to no more than 10%. In addition, according to FIG. 6, in examples in which the Mo segregation degree was no more than 0.20, the aspect ratio w/h of the casting mold was 1.0 or more and 2.0 or less.

It can be seen from FIGS. 3 to 6, in a case where the aspect ratio w/h of the casting mold used for the continuous casting was 1.0 or more and 2.0 or less, the reject ratio of the seamless pipes was reduced to no more than 10%. In specific, when the aspect ratio w/h of the casting mold used for continuous casting was 1.0 or more and 1.7 or less, the reject ratio of the seamless pipes was reduced to approximately no more than 5%.

Figure 7:
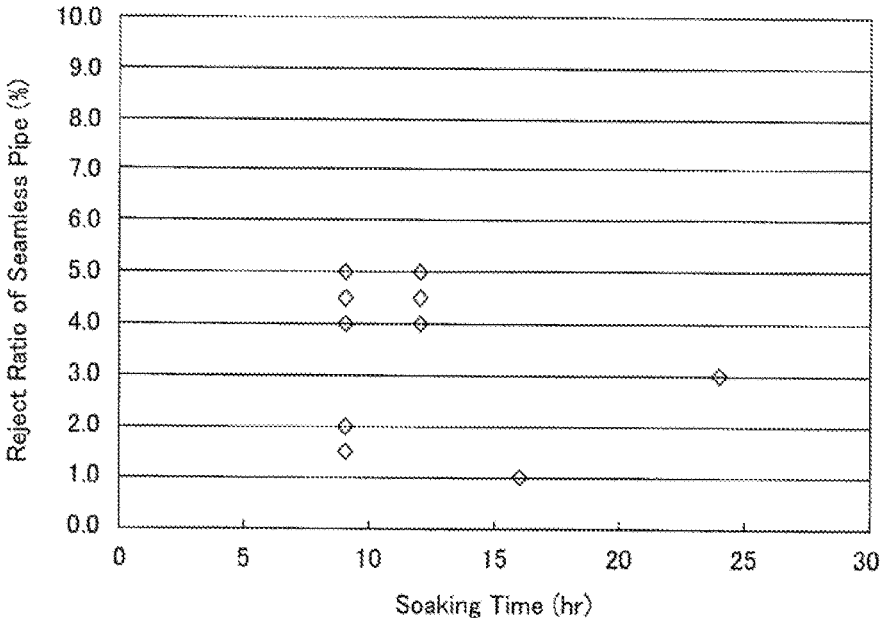
FIG. 7 is a scatter chart showing relationship between soaking time of the rectangular billet before shaping by forging and reject ratio of seamless pipe in a case where the ratio w/h of the casting mold is 1.0 to 1.7.

FIG. 7 is a scatter chart showing relationship between the soaking time of the rectangular billet before forging and the reject ratio of the seamless pipes in a case where the aspect ratio w/h of the casting mold used for continuous casting was 1.0 or more and 1.7 or less and the shaping method was forging. When the soaking time of the rectangular billet before forging was no less than 9 hours, the reject ratio of the seamless pipes was no more than 5%.

Figure 8:
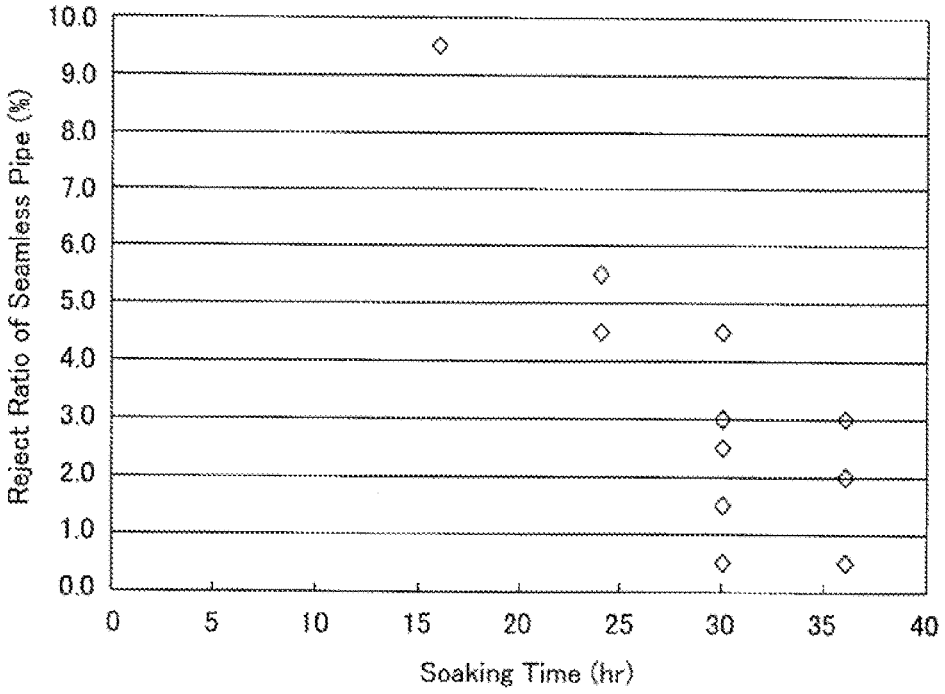
FIG. 8 is a scatter chart showing relationship between soaking time of the rectangular billet before shaping by rolling and reject ratio of seamless pipe in a case where the ratio w/h of the casting mold is 1.0 to 1.7.

FIG. 8 is a scatter chart showing relationship between the soaking time of the rectangular billet before rolling and the reject ratio of the seamless pipes in a case where the aspect ratio w/h of the casting mold used for continuous casting was 1.0 or more and 1.7 or less and the shaping method was rolling. When the soaking time of the rectangular billet before rolling was no less than 24 hours, the reject ratio of the seamless pipes was no more than 5%.

As shown in Tables 1 and 2, when the seamless pipes were manufactured from the round billets manufactured by the manufacturing method in the scope of the present invention (Items 1 to 31), the inner surface of each of the obtained seamless pipes has a good quality.

On the other hand, in Items 32 to 37 in which one of the aspect ratio w/h of the casting mold and chemical composition of the molten steel, or both of them were not in the scope of the present invention, each reject ratio of the seamless pipes was more than 10%. In addition, regarding Items 38 and 39, although good results were obtained, since the casting method was ingot casting method, it is inevitable that they are inferior to the manufacturing method of the present invention in cost and productivity.

DESCRIPTION OF THE REFERENCE NUMERALS

S1 manufacturing method for round billet of Ni-containing high alloy
S11 molten steel preparation step
S12 continuous casting step
S13 shaping step
S131 heating step
S132 soaking step
S133 forging/rolling step

The invention claimed is:

1. A method for manufacturing a round billet of Ni-containing high alloy, the method consisting essentially of:

continuously casting a molten steel by means of a casting mold, thereby obtaining a rectangular billet;

subjecting the rectangular billet to a soaking prior to any shaping of the rectangular billet, the rectangular billet soaked at 1200 to 1300° C. for a period of time; and shaping the rectangular billet subjected to the soaking into a round billet with a circular cross section by forging or rolling, wherein the casting mold has a shape such that a w/h ratio between long side length (w) and short side length (h) of a cross section of the rectangular billet is 1.1 to 2.0, and the cross section is perpendicular to the casting direction of the rectangular billet;

a ratio (A/B) of the cross section of the rectangular billet before the shaping step (A) to the cross section of the round billet with the circular cross section after the shaping step (B) is 2.5 to 12.0;

the period of time the rectangular billet is soaked is no less than 9 hours where the shaping is carried out by forging, and is no less than 24 hours where the shaping is carried out by rolling; and the chemical composition of the molten steel is:

C: 0.005 to 0.250% by mass,
Si: 0.05 to 2.00% by mass,
Mn: 0.05 to 3.00% by mass,
P: no more than 0.04% by mass,
S: no more than 0.004% by mass,
Cu: 0.01 to 3.00% by mass,
Cr: 10 to 35% by mass,
Ni: 30 to 80% by mass,
Mo: 1.5 to 10.0% by mass,
Al: 0.001 to 0.300% by mass,
N: 0.001 to 0.300% by mass,
W: 0.00 to 6.00% by mass,
Ti: 0.00 to 2.00% by mass, and
the balance: Fe and impurities;

a Mo segregation degree of the round billet is no more than 0.20; and the Mo segregation degree is a ratio $((c_{Mo}'-c_{Mo})/c_{Mo})$ of a difference $(c_{Mo}'-c_{Mo})$ between Mo concentration at the axial center of the round billet $(c_{Mo}')$ and Mo concentration in the molten steel $(c_{Mo})$ to Mo concentration in the molten steel $(c_{Mo})$.

2. The method for manufacturing a round billet of Ni-containing high alloy according to claim 1, wherein the w/h ratio is 1.1 to 1.7.

3. The method for manufacturing a round billet of Ni-containing high alloy according to claim 1, wherein the chemical composition of the molten steel contains:

W: 0.01 to 6.00% by mass.

4. The method for manufacturing a round billet of Ni-containing high alloy according to claim 1, wherein the chemical composition of the molten steel contains:

Ti: 0.05 to 2.00% by mass.

* * * * *